428-408 SR
8/25/87 XR 4,688,338

United States Patent [19]

Brown

[11] Patent Number: 4,688,338

[45] Date of Patent: Aug. 25, 1987

[54] ORTHOTIC INSERT FOR HIGH HEELED SHOES

[75] Inventor: Dennis N. Brown, Custer, Wash.

[73] Assignee: Northwest Podiatric Laboratories, Inc., Blaine, Wash.

[21] Appl. No.: 719,348

[22] Filed: Apr. 3, 1985

[51] Int. Cl.[4] ..... A43B 13/38

[52] U.S. Cl. ..... 36/44; 36/76 C; 36/80; 12/146 M; 12/146 S; 128/614; 428/408

[58] Field of Search ..... 36/44, 43, 76 C, 80, 36/22 A; 12/146 M, 146 S, 146 R, 142 N; 428/581, 586, 595, 614, 615

[56] References Cited

U.S. PATENT DOCUMENTS

| | | | |
|---|---|---|---|
| 2,644,250 | 7/1953 | Cialo | 36/76 C |
| 2,713,968 | 9/1939 | King . | |
| 4,023,801 | 5/1977 | Van Auken | 428/408 X |
| 4,186,499 | 2/1980 | Massok, Jr. et al. | 36/44 |
| 4,231,169 | 11/1980 | Toyama et al. | 36/44 X |
| 4,338,734 | 7/1982 | Schwartz | 36/44 |
| 4,368,234 | 1/1983 | Palmer et al. | 428/408 X |
| 4,439,934 | 4/1984 | Brown | 36/44 |
| 4,520,581 | 6/1985 | Irwin et al. | 36/44 |

FOREIGN PATENT DOCUMENTS

| | | |
|---|---|---|
| 1489605 | 10/1977 | United Kingdom . |
| 1521682 | 8/1978 | United Kingdom . |

OTHER PUBLICATIONS

*The Runner*, Nov. 1982, Paying Through the Feet, by Hal Higdon, pp. 86–90.

*Primary Examiner*—James Kee Chi
*Attorney, Agent, or Firm*—Hughes & Cassidy

[57] ABSTRACT

A rigid orthotic insert made of a plurality of layers bonded to one another, with each of the layers comprising parallel fibers, some of which are graphite. Along an outside edge of the insert, there is a layer of reinforcing graphite fibers. This arrangement desirably alleviates certain force patterns when high heels are worn, and also adds to comfort.

6 Claims, 16 Drawing Figures

ORTHOTIC INSERT FOR HIGH HEELED SHOES

CROSS REFERENCE TO RELATED APPLICATIONS

The subject matter of the present invention is related to the subject matter of five related patent applications being filed concurrently by the same applicant as in the present application, these five related applications being entitled: "Reinforced Heel Orthotic Insert", Ser. No. 719,324; "Orthotic Insert", Ser. No. 719,341; "Orthotic For Athletic Use", Ser. No. 719,347; "Reinforced Orthotic Insert", Ser. No. 719,413; and "Improved Orthotic for Running", Ser. No. 719,479.

The subject matter of these five related applications is hereby incorporated by reference to the same.

BACKGROUND OF THE INVENTION

1. Field of the Invention

The present invention relates to an orthotic insert, and more particularly for such an insert which is particularly adapted to function effectively throughout the gait cycle experienced in the common walking motion wearing high heeled shoes.

2. Background Art

An orthotic insert can be either soft or hard. A hard insert is a substantially rigid member, desirably having a relatively thin vertical thickness dimension and extending from the calcaneous area of the foot (the heel portion) to at least the metatarsal head area of the foot (i.e. that area at the "ball" of the foot). In general, the purpose of a rigid orthotic (sometimes called a functional orthotic) is to first position, and then to control the movements of, the midtarsal and subtalar joints during the gait cycle which the body goes through in walking and running, and also possibly for other movements.

It is believed that a clearer understanding of the background of the present invention will be achieved by first discussing generally: (a) the main components or parts of the human leg and foot and how these function relative to one another; (b) the gait cycle which a person goes through in a normal walking motion; (c) the gait cycle where high heeled shoes are worn; and (d) the intended function of a rigid orthotic in optimizing the coordinated operation of the person's foot and leg throughout the gait cycle.

For convenience, these various topics will be discussed under appropriate subheadings.

(a) The Main Components or Parts of the Human Leg and Foot and How These Function Relative to One Another With reference to FIGS. 1–3, there is shown a typical human foot 10, and (in FIGS. 2 and 3) the lower part 12 of the leg 14. The two lower bones of the leg 14 are the tibia 16 and the fibula 18. Below the tibia 16 and fibula 18, there is the talus 20 (i.e. the "ankle bone"). Positioned below and rearwardly of the talus 20 is the calcaneus 22 (i.e. the heel bone). Positioned moderately below and forward of the talus 20 are the navicular 24 and the cuboid 26. Extending forwardly from the navicular 24 are the three cuneform bones 28. Extending forwardly from the cuneform bones 28 and from the cuboid 26 are the five metatarsals 30. Forwardly of the metatarsals 30 are the phalanges 32 which make up the five toes 34.

The movement of the talus 20 relative to the tibia 16 and fibula 18 is such that it enables the entire foot to be articulated upwardly and downwardly (in the motion of raising or lowering the forward part of the foot) and also to permit the entire foot 10 to be moved from side to side. However, the talus 20 is connected to the tibia 16 and fibula 18 in such a way that when the entire leg 14 rotated about its vertical axis (i.e. the axis extending the length of the leg), the talus 20 rotates with the leg 14.

With regard to the relationship of the talus 20 to the calcaneus 22, these move relative to one another about what is called the "subtalar joint" indicated at 36. The subtalar joint 36 can be described generally as a hinge joint about which the talus 20 and calcaneus 22 articulate relative to one another. The hinge axis extends upwardly and forwardly at an angle of about 42° from the horizontal, and also slants forwardly and inwardly at a moderate angle (e.g. about 16° from a straightforward direction).

To explain further the hinge motion of the subtalar joint 36, reference is now made to FIGS. 4*a* and 4*b*. The talus 20 can be considered as a vertical board 40, and the calcaneus 22 as a horizontally extending board 42, these being hinge connected to one another along a diagonal hinge line 44, with this hinge line corresponding to the subtalar joint 36. It can be seen with reference to FIG. 4*a* that as the talus 20 is rotated inwardly about its vertical axis (i.e. the front part of the leg being rotated toward the center of the person's body), there is a corresponding rotation of the calcaneus 22 (i.e. the horizontal board 42) about a horizontal axis. It can be seen in FIG. 4*b* that an opposite (i.e. outward) rotation of the talus 20 (i.e. the vertical board 40) causes a corresponding rotation of the calcaneus 22 (i.e. the horizontal board 42) in the opposite direction to that shown in FIG. 4*a*.

This motion described with reference to FIGS. 4*a* and 4*b* above is critical in the gait cycle (i.e. the cycle through which the person goes in normal walking or running motion), and this will be discussed more fully below.

With regard to the midtarsal joint 38, this is in reality composed of two separate joints, the talo-navicular and the calcaneal-cuboid. It is a complex joint, and no attempt will be made to illustrate or recreate its motion accurately. Instead, there will be presented a somewhat simplified explanation of its function as it relates to the present invention.

The main concern, relative to the midtarsal joint, is not the precise relative motion of the parts of the foot that make up this joint, but rather the locking and unlocking mechanism of the midtarsal joint which occurs when there is an outward motion of the leg 14 and the talus 20 (outward motion meaning the rotation of the leg 14 and foot 10 about the vertical axis of the leg 14 in a manner that the knee moves outwardly from the person's body), and an opposite inward motion, respectively. When the leg 14 rotates inwardly, the midtarsal joint 38 unlocks so that the portion of the foot 10 forwardly of the joint 38 (i.e. the midfoot 45) is flexible, this being the "pronated" position of the foot. On the other hand, when the leg 14 and talus 20 rotate outwardly, the foot is said to be "supinated" so that the midtarsal joint 38 is locked and the midfoot 45 essentially becomes a part of a rigid lever. In actuality, the midfoot 45 never becomes totally rigid, so that even in the totally supinated position, there is some degree of flexibility in the midfoot 45.

This function of the midtarsal joint will now be explained relative to FIGS. 5*a* and 5*b*. It can be seen that FIGS. 5*a–b* are generally the same as FIGS. 4*a–b*, except that a forward board member 46 is shown to represent the midfoot 45, this member 46 having a downward taper in a forward direction, and also a lower horizontal plate portion 48. This plate portion 48 is intended to represent that the plantar surface (i.e. the lower support surface) of the midfoot 45 engages the underlying support surface in a manner so as to remain generally horizontal to the support surface.

It can be seen that when the two board members 40 and 42 are in the pronated position of FIG. 5*a*, the metatarsal joint represented at 50 in FIGS. 5*a–b* is in a first position which will be presumed to be an unlocked position. In the unlocked position of FIG. 5*a*, the member 46 is not rigid with the horizontal member 42, and the forward member 46 can flex upwardly relative to the horizontal member 42. (This is the pronated position of the foot 10.) However, in the position of FIG. 5*b*, the board members 46 and 42 will be presumed to be locked to one another so that the members 42 and 46 form a unitary lever. For ease of illustration, no attempt has been made to illustrate physically the unlocking relationship of FIG. 5*a* and the locking relationship of FIG. 5*b*. Rather, the illustrations of FIGS. 5*a–b* are to show the relative movement of these components, and the locking and unlocking mechanism is presumed to exist.

(b) The Gate Cycle Which the Person Goes Through in a Normal Walking Motion

Reference is first made to FIGS. 6*a* and 6*b*. As illustrated in the graph of FIG. 6*a*, during the normal walking motion, the hip (i.e. the pelvis) moves on a transverse plane, and this movement in the gait cycle is illustrate in FIG. 6*b*. Also, the femur (i.e. the leg bone between the knee joint and the hip) and the tibia rotate about an axis parallel to the length of the person's leg. (It is this rotation of the leg about its vertical axis which in large part causes the pronating and supinating of the foot during the gait cycle, and this will be explained in more detail below.)

There is also the flexing and extension of the knee, as illustrated in the five figures immediately below the graph of FIG. 6*a*. Further, there is the flexing and extension of the ankle joint. At the beginning of the gait cycle, the heel of the forwardly positioned leg strikes the ground, after which the forward part of the foot rotates downwardly into ground engagement. After the leg continues through its walking motion to extend rearwardly during the gait cycle, the person pushes off from the ball of the foot as the other leg comes into ground engagement.

The motions described above are in large part generally apparent to a relatively casual observation of a person walking. However, the motion which is generally overlooked by those not familiar with the gait cycle is the inward and outward rotation of the leg about its lengthwise axis to cause the pronating and supinating of the foot through the gait cycle. This will be described relative to FIG. 7*a* and FIG. 7*b*.

When the leg is swung forwardly and makes initial ground contact, at the moment of ground contact the leg is rotated moderately to the outside (i.e. the knee of the leg is at a more outward position away from the centerline of the body) so that the foot is more toward the supinated position (i.e. closer to the position shown in FIG. 4*b*) However, as the person moves further through the gait cycle toward the 25% position shown in FIG. 7*a*, the leg rotates about its vertical axis in an inside direction so that the subtalar joint is pronating. The effect of this is to rotate the heel of the foot so that the point of pressure or contact moves from an outside rear heel location (shown at 52 in FIG. 7*b*) toward a location indicated at 54 in FIG. 7*b*. This pronating of the subtalar joint 36 produces a degree of relaxation of the midtarsal joint 38 and subsequent relaxation of the other stabilization mechanisms within the arch of the foot. This reduces the potential shock that would otherwise be imparted to the foot by the forward part of the foot making ground contact.

With further movement from the 25% to the 75% position, the leg rotates in an opposite direction (i.e. to the outside) so that the midtarsal joint 38 becomes supinated at the 75% location of FIG. 7*a*. This locks the midtarsal joint 38 so that the person is then able to operate his or her foot as a rigid lever so as to raise up onto the ball of the foot and push off as the other leg moves into ground contact at a more forward location.

With reference again to FIG. 7*b*, the initial pressure at ground contact is at 52 and moves laterally across the heel to the location at 54. Thereafter, the pressure center moves rather quickly along the broken line indicated at 56 toward the ball of the foot. As the person pushes off from the ball of the foot and then to some extent from the toes of the foot, the center of pressure moves to the location at 58.

(c) The Gait Cycle Where High Heeled Shoes Are Worn

When a person is wearing high heeled shoes, the overall gait cycle is generally similar to what was described immediately above. However, with the plantar surface of the foot being slanted in a forward and downward direction during the entire period of ground contact, the pattern of applying the force is somewhat modified.

One of the significant differences is that when the heel is raised, the inside portion of the ball of the foot tends to bear greater weight than the outside portion. The reason for this is that the ball of the foot at the outside portion is positioned somewhat rearwardly, relative to the inside ball portion of the foot.

(d) The Intended Function of the Orthotic to Improve Operation of the Person's Foot and Leg Throughout the Gate Cycle If the person's foot were perfectly formed, then there would be no need for an orthotic device. However, the feet of most people deviate from the ideal. Accordingly, the function of the orthotic is first to position the plantar surface of the calcaneus 22 and the midfoot 45 so that the subtalar and midtarsal joints 36 and 38 are initially positioned properly, and to thus control the subsequent motion of the foot parts or components that make up these joints so that the movements of the hip, leg and foot throughout the gait cycle are properly accomplished. It can be readily understood that if the components of the foot have the proper initial position and movement about the subtalar and midtarsal joints 36 and 38, the entire gait cycle, all the way from the coordinated rotation of the hips through the flexing and rotation of the leg, and also through the initial strike of the heel on the ground to the final push off from the toe of the foot, is properly coordinated and balanced for optimum movement.

Since shoes are generally manufactured on a mass production basis, the supporting surface of the interior of the shoe may or may not optimally locate the plantar surface of the foot. Accordingly, it has for many years been a practice to provide an orthotic insert which fits within the shoe to optimize the locations of the foot components. In general, these inserts have been made of various materials, some of which are formed as laminated structures to provide a relatively rigid support for the heel and midfoot regions of the foot.

These orthotics can be formed in a variety of ways. A preferred method of forming an orthotic insert is described in the applicant's U.S. Pat. No. 3,995,002. In that method, there is formed a negative mold or slipper cast from which a positive cast of the plantar surface of the individual's foot is formed. Using this positive cast as a template, an orthotic insert is formed to underlie an area under the foot. The insert itself is fabricated by applying to the positive cast the material which is to orthotic insert. The precise configuration of the insert will depend upon the prescribed corrective measures to be taken for the individual's foot.

SUMMARY OF THE INVENTION

The present invention embodies the broad teachings of U.S. Pat. No. 4,439,934, and provides specific improvements for the same.

There is a substantially unitary orthotic insert adapted to be placed in an article of footwear, said insert having a longitudinal axis parallel to a lengthwise axis of the foot for which the insert is used, and a transverse axis. The insert comprises a rear portion adapted to underlie and engage a plantar surface of a calcaneal area of the foot. There is a forward portion adapted to underlie and engage a plantar surface of a metatarsal head area of the foot.

There is an intermediate portion connecting to and extending between the rear and forward portions to engage the plantar surface of a midfoot area of the foot. The insert has outside and inside edge portions adapted to be positioned adjacent an outside edge and an inside edge of the foot, respectively.

The insert has a laminated structure comprising a plurality of vertically stacked layers bonded to one another to form a substantially unitary structure. The laminated structure comprises first laminate means having an internal material structure adapted to resist bending moments generally uniformly about both of said longitudinal and transverse axes. There is a second laminate means comprising at least one layer having fibers which are generally aligned with the longitudinal axis so as to provide greater resistance to bending moments along the longitudinal axis, and less resistance to bending along the transverse axis.

There is a third laminate means comprising at least one layer comprising fibers generally aligned with the longitudinal axis. This third laminate means is positioned along the outside edge portion of the insert so as to provide greater resistance to bending moments along the longitudinal axis at the outside edge portion of the insert.

In the preferred form, there is fourth laminate means comprising at least one layer having a plurality of generally parallel fibers. These fibers have a predominant orientation of al.. about a direction extending from a rear outside location to a forward inside location. This provides greater resistance to bending moments along an axis extending from a rear outside location to a forward inside location generally parallel to said orientation.

In the preferred configuration, the fourth laminate means has a width dimension narrower than that of the insert. Thus, the resistance to bending moments is localized relative to the width dimension of the insert. Desirably, for specific application, the fourth insert means is generally centralized relative to the insert.

Also, in the preferred embodiment, the third laminate means has a length dimension less than a length dimension of the insert, with the forward end of the third laminate means terminating at a location rearwardly of a forward end of the insert.

In the preferred configuration, the fibers comprise graphite fibers.

Other features of the present invention will become apparent from the following detailed description.

DESCRIPTION OF THE PREFERRED EMBODIMENTS

The present invention comprises a more specific improvement of the orthotic insert described in the applicant's issued U.S. Pat. No. 4,439,934.

As described in that patent, the overall method for forming the insert is generally the same as that described in applicant's U.S. Pat. No. 3,995,002. There is first provided a negative mold, from which a positive cast (i.e. a cast resembling the structure of a person's foot) is formed. Using this positive cast as a template, an orthotic insert is formed to underlie the area of the foot from the calcaneal area forward to the first metatarsal head, including the arch area, and from there laterally to the distal side of the foot or fifth metatarsal head. The insert itself is fabricated by applying to the positive cast layers of fiber impregnated with resin. The assembled layers are then heat cured and cut to the limits of the cast.

As further discussed in the applicant's U.S. Pat. No. 4,439,934, the flexing characteristics of the insert, which are integral to its performance, can be beneficially controlled by adjusting the placement, amount and direction of graphite fibers, and in some instances, other fibers such as glass fibers. The insert so formed is extremely light weight and relatively thin in comparison to conventional orthotic inserts.

Figure 1:
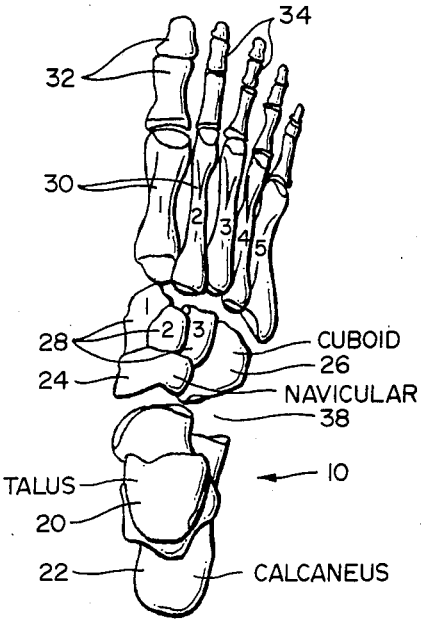
FIG. 1 is a top plan view of the right foot of a human, with certain components of the foot being separated from one another for purposes of illustration.
Figure 2:
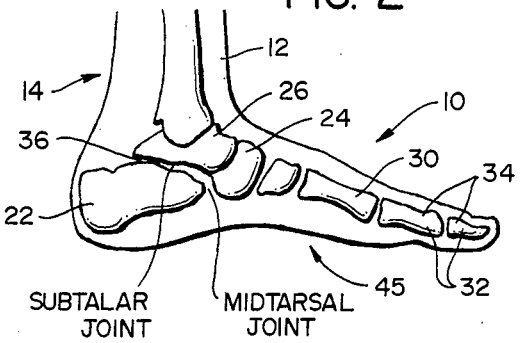
FIG. 2 is a side elevational view looking toward the inside of a person's left foot, with the outline of the foot and lower leg being shown as a shaded area.
Figure 3:
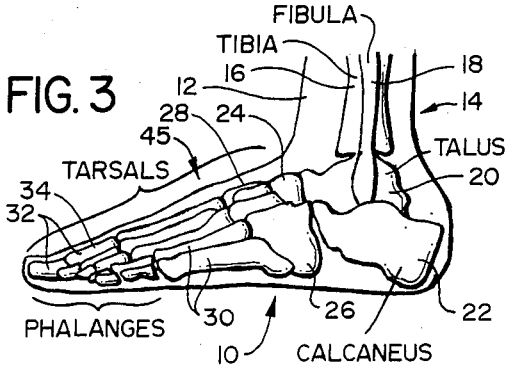
FIG. 3 is a view similar to FIG. 2, but looking toward the outside of the person's foot.
Figure 4A:
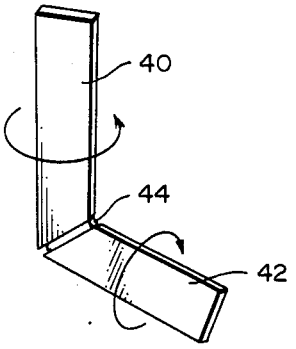
FIGS. 4*a* and 4*b* are perspective views illustrating schematically the rotational movements of the talus and calcaneus about the subtalar joint.
Figure 4B:
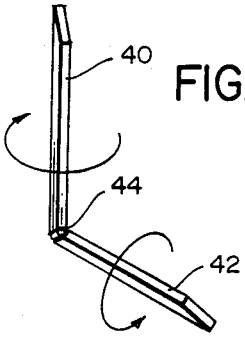
Figure 5A:
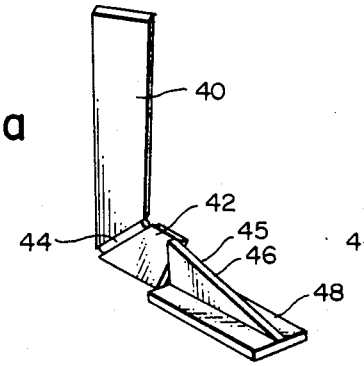
FIGS. 5*a* and 5*b* are schematic views similar to those of FIGS. 4*a–b*, but further illustrating the relative movement between the calcaneus and the midfoot about the midtarsal joint.
Figure 5B:
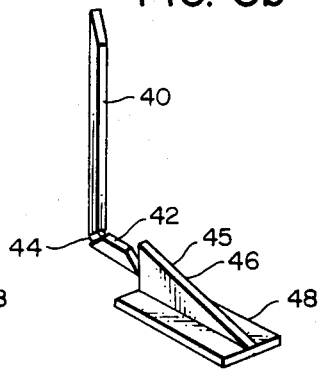
Figure 6A:
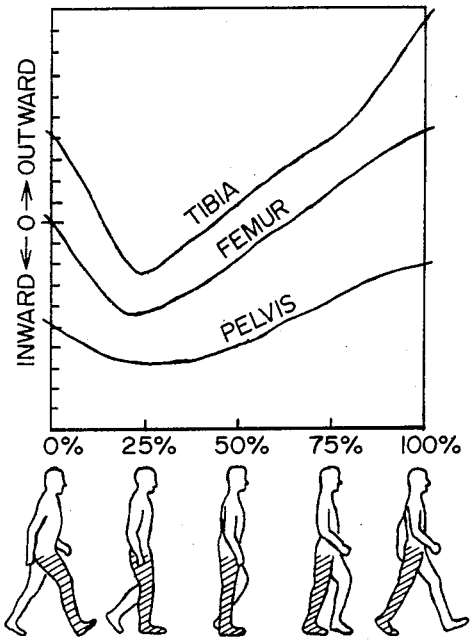
FIG. 6*a* is a graph illustrating the rotational movement of the pelvis, femur and tibia during one-half of a gait cycle.
Figure 6B:
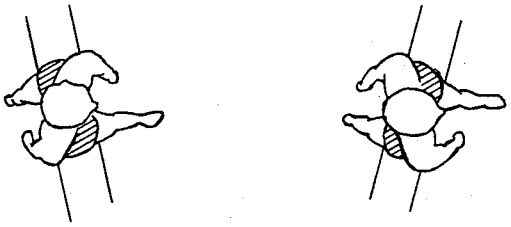
FIG. 6*b* is a top plan view illustrating the rotation of the person's pelvis during that portion of the gait cycle illustrated in FIG. 7*a;*
Figure 7A:
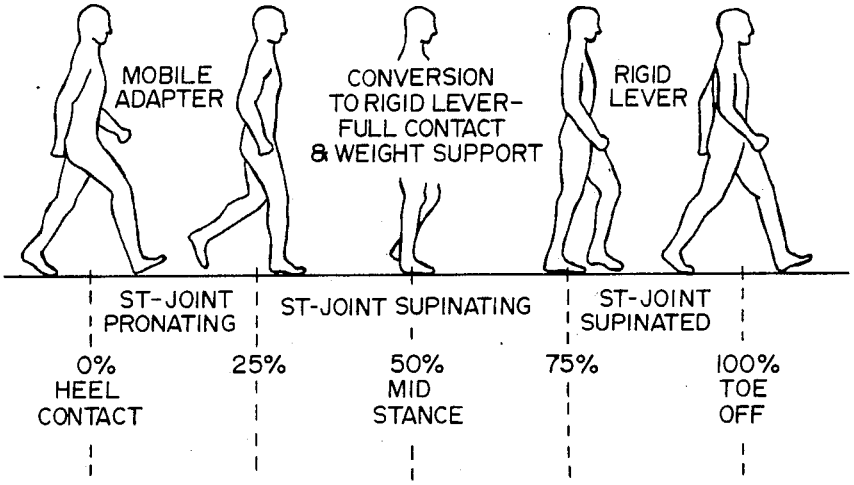
FIG. 7*a* is a graph similar to FIG. 6*a*, but illustrating the timing of the pronating and supinating motion of the leg and foot through one-half of a gait cycle.
Figure 8:
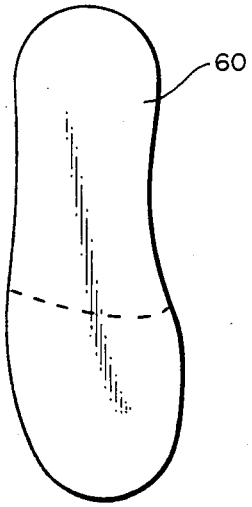
FIG. 8 is a top plan view of an upper soft portion of an orthotic device, made to fit a person's right foot.

To proceed to a more detailed description of the present invention, in FIG. 8, there is shown a two layered first blank 60 which is generally configured to the outline of a bottom of an individual's foot. This blank 60 can be of conventional configuration. For example, it can include an upper layer of a cloth material such as nylon, Dacron, cotton or the like which is abrasion resistant and absorbs perspiration well. It can further comprise a second layer of flexible rubber or neoprene or the like which is co-extensive with and adheres to the upper layer. While this first blank 60 is desirably used in the present invention, within the broader aspects of the present invention, this blank 60 is not an absolutely necessary element.

Figure 9:
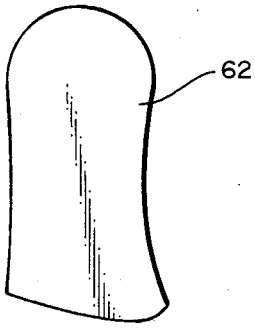
FIG. 9 is a top plan view of another portion of the orthotic insert toward which the subject matter of the present invention is particularly directed.
Figure 10:
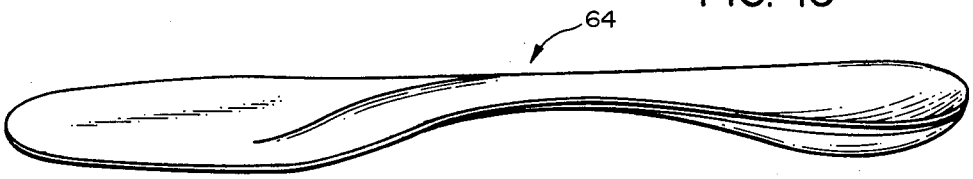
FIG. 10 is an isometric view of an insert made in accordance with the present invention.
Figure 7B:
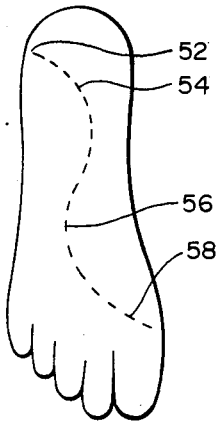
FIG. 7*b* is a view looking upwardly toward the plantar surface of a person's left foot, and illustrating the distribution or location of the center of pressure throughout the period of ground contact of the portion of the gait cycle illustrated in FIGS. 6*a* and 7*a;*

In FIG. 9, there is a second blank 62 which incorporates the teachings of the present invention. In the end configuration of the present invention, this blank 62 underlies the blank 60 and is bonded thereto. The end configuration of the two blanks 60 and 62 is illustrated in FIG. 10, which is a perspective view of the end product.

In the applicant's earlier patent, U.S. Pat. No. 4,439,934, the method of forming the blank 62 was described generally. This blank 62 can be formed and contoured around a positive cast obtained using the method and apparatus disclosed in applicant's U.S. Pat. No. 3,995,002. Then various arrangements of layers of fiberglass or graphite, impregnated with resin, are laid upon the positive cast to form the second blank 62.

With respect to the novel features of the present invention, it has been found that within the broad teaching of U.S. Pat. No. 4,439,934, the orientation of certain of the fibers in the layer or layers can be selected in certain configuration to improve the performance characteristics of the orthotic insert in specific ways.

Figure 11:
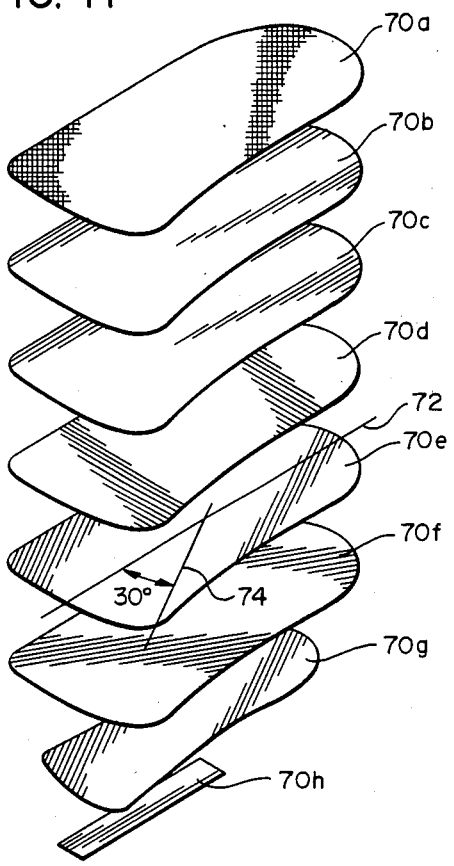
FIG. 11 is a perspective view of eight layers utilized in forming the insert section of the present invention, as illustrated in FIG. 9.

As illustrated in FIG. 11, there are eight layers, designated 70*a–h*. The top layer 70*a* comprises a fiberglass resin layer, where the fiberglass strands are arranged in a right angle crossing pattern. The fiberglass layer is cut so that in the end configuration, the two sets of strands are at a 45° angle to the lengthwise or longitudinal axis 72 of the insert. Thus, the overall resistance to bending imparted by this layer 70*a* is generally uniform for a given thickness over the face of the insert.

The layers 70*b* and 70*c* are identical, and these are made up of graphite fibers impregnated with a suitable resin. The orientation of these fibers is parallel to the longitudinal axis 72.

The layer 70*d* is a graphite layer, made up of graphite fibers impregnated with resin. The orientation of the fibers of the layer 70*d* is transverse (i.e. at right angles to the longitudinal axis 72).

The layer 70*e* is made up of a plurality of graphite strands or fibers, impregnated with resin. The fibers or strands extend in a diagonal line from a rear outside portion of the insert toward a forward inside portion of the insert. As shown herein, the graphite strands are desirably oriented at 30° off the horizontal axis. In the preferred form, however, this precise orientation can vary depending upon the particular function to be accomplished. In general, the orientation of these strands (indicated by the line 74) relative to the longitudinal axis 72 would be greater than 0° from the longitudinal axis 72, and generally no greater than about one-half of a right angle from the longitudinal axis 72.

The sixth layer 70*f* is substantially the same as the fifth layer 70*e*, except that the orientation of the graphite fibers is opposite to that of the layer 70*e*. Thus, the fibers of the layer 70*f* extend from a rear inside location to a forward outside location, with the angular displacement from the longitudinal axis 72 being approximately the same as that of the layer 70*e*, but in an opposite direction.

Figure 12:
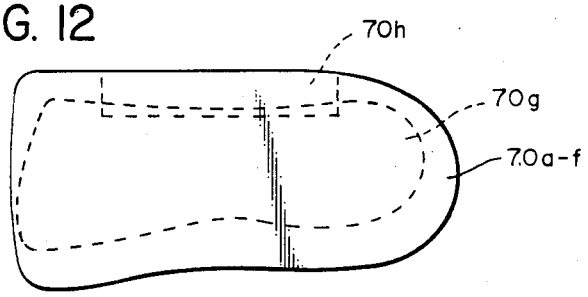
FIG. 12 is a top plan view of the insert made in accordance with the stack up of FIG. 11.

The seventh layer 70*g* is also made up of graphite fibers impregnated with resin, and the fibers have the same orientation as the layers 70*e*. However, the width dimension of the layer 70*g* is somewhat less, and as shown in FIG. 12, the layer 70*g* is centered relative to the stack up. Obviously, for particular conditions, the precise location of this layer 70*g* could be modified.

Finally, there is a lower layer or strip 70*h*. This has the same composition as the other layers, and the graphite fibers are positioned so as to be parallel to the longitudinal axis 72. Further, the length of the strip 70*h* is somewhat shorter than that of the other layers, with the forward and rear ends of the layer 70*h* being positioned rearwardly and forwardly of the forward and rear portions of the other layers, respectively. While the strip 70*h* is shown being positioned along the outside edge, this position could be varied depending upon certain specific circumstances.

With this particular configuration, the insert section 62 made from this stack up would provide suitable support and greater comfort for a person wearing high heeled shoes, with the support provided from the insert section 62 properly positioning the foot components for the desired positioning and movement, as described previously herein.

The layers 70*a–h* are bonded and cured to form the unitary blank 62. More specifically, the layers 70*a–h* can be conformed to the contour of the mold, preheated for a period of time, cured at, for example, 350° F. for about 45 minutes, and then be affixed to the bottom of the first blank 60 to create the final insert 64.

The section 62 of the insert 64 can functionally be considered as having two portions. First, there are those layers which cooperate to resist bending moments generally uniformly about both of the longitudinal and transverse axes. This is true of layer 70*a*, and the combination of layers 70*d–f* serve generally the same function.

This insert also has the function of resisting bending moments primarily along the longitudinal axis. This function is contributed by the layers 70*b–c*.

The layer 70*g* gives added reinforcement to a narrower portion of the foot, and the resistance to bending is primarily along a diagonal axis 74.

Finally, the layer 70*h* adds strength to the outside edge of the foot primarily along the middle edge portion, in a manner to resist bending loads along the longitudinal axis.

It is to be understood that within the broader scope of the embodiments shown herein, the angular variation of the fibers can be modified, depending upon the special requirements of the person's foot. Also, while the particular layup of these layers has been found to be quite advantageous, it is to be understood that certain additions or deletions could be made depending upon the particular circumstances relating to that person's foot. Also, the order or placement of the layers could be modified and still function within the general mode of operation of the present invention.

I claim:

1. A substantially unitary orthotic insert adapted to be placed in an article of footwear, said insert having a longitudinal axis parallel to a lengthwise axis of a foot for which the insert is used, and a transverse axis, said insert comprising:

a. a rear portion adapted to underlie and engage a plantar surface of a cacaneal area of the foot;

b. a forward portion adapted to underlie and engage a plantar surface of a metatarsal head area of the foot;

c. an intermediate portion connecting to and extending between said rear and forward portions to engage a plantar surface of a mid-foot area of the foot;

d. said insert having outside and inside edge portions adapted to be positioned adjacent an outside edge and an inside edge of the foot, respectively;

e. said insert having a laminated structure comprising a plurality of vertically stacked layers bonded to one another to form a substantially unitary structure, said laminated structure comprising:

1. first laminate means having an internal material structure adapted to resist bending moments generally uniformly about both of said longitudinal and transverse axes;

2. a second laminate means comprising at least one layer having fibers which are generally aligned with said longitudinal axis so as to provide greater resistance to bending moments along said longitudinal axis, and less resistance to bending along said transverse axis;

3. a third laminate means comprising at least one layer comprising fibers generally aligned with said longitudinal axis, and being positioned along the outside edge portion of said insert so as to provide greater resistance to bending moments along the longitudinal axis at the outside edge portion of the insert.

2. The insert as recited in claim 1, wherein there is fourth laminate means comprising at least one layer having a plurality of generally parallel fibers, which have a predominant orientation of alignment about a direction extending from a rear outside location to a forward inside location, so as to provide greater resistance to bending moments along an axis extending from a rear outside location to a forward inside location generally parallel to said orientation.

3. The insert as recited in claim 2, wherein said fourth laminate means has a width dimension narrower than that of the insert, whereby said resistance to bending moments is localized relative to the width dimension of the insert.

4. The insert as recited in claim 3, wherein said fourth laminate means is generally centralized relative to said insert.

5. The insert as recited in any of claims 1, 2, 3 or 4, wherein said third laminate means has a length dimension less than a length dimension of the insert, with a forward end of said third laminate means terminating at a location rearwardly of a forward end of

6. The insert as recited in any one of claims 1, 2, 3 or 4, wherein said fibers comprise graphite fibers.

* * * * *